US009604766B2

(12) United States Patent
Dyrbye et al.

(10) Patent No.: US 9,604,766 B2
(45) Date of Patent: Mar. 28, 2017

(54) DISPENSING CAP FOR BEVERAGE CONTAINER

(71) Applicant: From The Earth Naturally Ltd., St. Albert (CA)

(72) Inventors: Anita Dyrbye, St. Albert (CA); Dave Dyrbye, St. Albert (CA)

(73) Assignee: FROM THE EARTH NATURALLY LTD., St. Albert (CA)

( * ) Notice: Subject to any disclaimer, the term of this patent is extended or adjusted under 35 U.S.C. 154(b) by 0 days.

(21) Appl. No.: 14/960,632

(22) Filed: Dec. 7, 2015

(65) Prior Publication Data

US 2016/0083156 A1 Mar. 24, 2016

Related U.S. Application Data

(60) Division of application No. 14/018,364, filed on Sep. 4, 2013, now Pat. No. 9,211,984, which is a continuation of application No. 13/450,381, filed on Apr. 18, 2012, now abandoned, which is a continuation-in-part of application No. 12/937,516, filed as application No. PCT/CA2009/000452 on Apr. 7, 2009, now abandoned.

(Continued)

(51) Int. Cl.
*B67D 7/74* (2010.01)
*B65D 51/28* (2006.01)

(52) U.S. Cl.
CPC ..... *B65D 51/2835* (2013.01); *B65D 51/2828* (2013.01); *B65D 51/2864* (2013.01)

(58) Field of Classification Search
CPC ..... B65D 47/243; B65D 51/2835; B65D 2251/0015; B65D 2251/0056; B65D 51/2828; B65D 51/2864
USPC ..... 222/80, 81, 83, 83.5, 129
See application file for complete search history.

(56) References Cited

U.S. PATENT DOCUMENTS 3,580,423 A 5/1971 Gilman
3,768,697 A * 10/1973 Lerner ..... B67B 7/26 222/80

(Continued)

FOREIGN PATENT DOCUMENTS

DE 3140398 A1 9/1982
DE 4238819 A1 5/1993

(Continued)

*Primary Examiner* — Patrick M Buechner
*Assistant Examiner* — Jeremy W Carroll
(74) *Attorney, Agent, or Firm* — Donald V. Tomkins

(57) ABSTRACT

A dispensing cap sealingly mountable within the throat of a beverage container has an open-bottomed flow tube connected to a surrounding skirt by a resilient diaphragm, forming a reservoir surrounding the flow tube. A membrane attached to the periphery of the skirt seals off the bottom of the reservoir. The lower end of the flow tube extends into the reservoir and is adapted for piercing the membrane. A downward force applied to the flow tube will resiliently deform the diaphragm, causing the lower end of the flow tube to pierce the membrane, thus allowing the contents of the reservoir to flow into the container. The flow tube extends above the diaphragm and terminates in a flow assembly operable between a closed position and a "consume" position in which the contents of the container can flow through the flow tube and out an opening in the cap sleeve.

6 Claims, 8 Drawing Sheets

Related U.S. Application Data

(60) Provisional application No. 61/045,896, filed on Apr. 17, 2008.

(56) References Cited

U.S. PATENT DOCUMENTS

| | | | |
|---|---|---|---|
| 4,103,772 | A | 8/1978 | Wiegner |
| 4,174,035 | A | 11/1979 | Wiegner |
| 4,315,570 | A | 2/1982 | Silver et al. |
| 5,141,133 | A | 8/1992 | Ninomiya et al. |
| 5,217,433 | A | 6/1993 | Bunin |
| 5,255,812 | A | 10/1993 | Hsu |
| 5,421,483 | A | 6/1995 | Parise |
| 5,542,528 | A | 8/1996 | Lanfranconi et al. |
| 5,839,573 | A | 11/1998 | Morini |
| 5,927,549 | A | 7/1999 | Wood |
| 5,957,335 | A | 9/1999 | Otto |
| 5,984,141 | A | 11/1999 | Gibler |
| 5,992,692 | A | 11/1999 | Boissay |
| 6,095,375 | A | 8/2000 | Adams et al. |
| 6,182,865 | B1 | 2/2001 | Bunschoten et al. |
| 6,290,100 | B1 | 9/2001 | Yacko et al. |
| 6,435,341 | B1 | 8/2002 | Nobbio |
| 6,454,088 | B2 | 9/2002 | Mollstam et al. |
| 6,513,650 | B2 | 2/2003 | Mollstam et al. |
| 6,540,070 | B1 | 4/2003 | Conwell |
| 6,854,595 | B2 | 2/2005 | Kiser |
| 6,959,839 | B2 | 11/2005 | Roth et al. |
| 7,503,453 | B2 | 3/2009 | Cronin et al. |
| 7,882,976 | B1 | 2/2011 | Goede |
| 2001/0000794 | A1 | 5/2001 | Daubert et al. |
| 2004/0262328 | A1 | 12/2004 | Nilsen |
| 2005/0150903 | A1 | 7/2005 | Py et al. |
| 2006/0108376 | A1 | 5/2006 | Muir |
| 2007/0074979 | A1 | 4/2007 | Cho |
| 2007/0090000 | A1 | 4/2007 | Hjalmarsson |
| 2007/0138179 | A1 | 6/2007 | Jacobs et al. |
| 2007/0205218 | A1 | 9/2007 | Mueller et al. |
| 2007/0267435 | A1 | 11/2007 | Yamada et al. |
| 2007/0284265 | A1 | 12/2007 | Parker |
| 2008/0067172 | A1 | 3/2008 | Wilhelm |
| 2008/0073307 | A1 | 3/2008 | Sweeney et al. |
| 2008/0093381 | A1 | 4/2008 | Smith et al. |
| 2008/0116221 | A1 | 5/2008 | Roth et al. |
| 2008/0179331 | A1 | 7/2008 | Sharp |
| 2009/0127274 | A1 | 5/2009 | Mueller et al. |
| 2010/0308057 | A1 | 12/2010 | Hart |
| 2011/0049183 | A1 | 3/2011 | Wiederer |

FOREIGN PATENT DOCUMENTS

| | | | |
|---|---|---|---|
| FR | 1178115 | | 5/1959 |
| FR | 2814156 | | 3/2002 |
| JP | 2002282565 | | 4/2004 |
| WO | 02074647 | A1 | 9/2002 |
| WO | 2004060766 | A1 | 7/2004 |
| WO | 2004085278 | A1 | 10/2004 |
| WO | 2004089777 | A2 | 10/2004 |
| WO | 2006050538 | A1 | 5/2006 |

* cited by examiner

DISPENSING CAP FOR BEVERAGE CONTAINER

FIELD OF THE DISCLOSURE

The present disclosure relates in general to beverage container closure devices having reservoirs for holding an additive substance, and operative to dispense the additive substance into the container to facilitate mixing of the additive substance with the beverage.

BACKGROUND

It is known to use dispensing caps and closures with beverage containers such as bottled water and sport beverages. A dispensing cap incorporates a reservoir for receiving a quantity or dose of an additive substance, to be mixed with the base liquid (e.g., water; sport beverage) in the container. The additive substance could be of various types, and could be in either liquid or powdered form; examples would include flavoring ingredients, medicinal or pharmaceutical agents, dietary supplements, and therapeutic substances. Some additives may have diminished efficacy if mixed with the base liquid a significant length of time before consumption, or early mixing could reduce the mixture's shelf life. In other cases, such as for medicinal, therapeutic, or other health-related additives, proper proportioning of the additive may be important to ensure that the additive will have the desired benefits for the person consuming the mixture. Provision of the additive in a dispensing cap facilitates precise proportioning of the additive and base liquid, and also allows a consumer to ensure optimal freshness of the additive/base liquid mixture by dispensing the additive into the base liquid just prior to consumption.

The prior art discloses numerous examples of container closures for dispensing an additive into the container, including the following patent documents:

DE 31 40 398 A1
DE 42 38 819 A1
FR 1178 115 A1
FR 2 814 156 A1
JP 2002-282565
U.S. Pat. No. 4,315,570 A1
U.S. Pat. No. 5,217,433
U.S. Pat. No. 5,542,528
U.S. Pat. No. 5,839,573
U.S. Pat. No. 5,957,335
U.S. Pat. No. 6,435,341 B1
U.S. Pat. No. 6,513,650 B2
U.S. Pat. No. 6,540,070 B1
U.S. Pat. No. 6,854,595 B2
U.S. Pat. No. 6,959,839 B2
U.S. Pat. No. 7,503,453 B2
US 2007/0074979 A1
US 2007/0090000 A1
US 2008/0067172 A1
US 2008/0073307 A1
US 2008/0093381 A1
US 2008/0116221 A1
WO 2006/050538 A1
WO 2008/014444 A2

Notwithstanding the identified prior art, there remains a need for an improved dispensing cap for beverage containers.

BRIEF SUMMARY

In general terms, the present disclosure teaches a dispensing cap that may be screwed onto or otherwise sealingly mounted to a conventional beverage container, and which may be actuated to dispense an additive substance from a reservoir within the dispensing cap, into the beverage container. The dispensing cap has an open-bottomed flow tube which is connected to a surrounding skirt by means of a resilient diaphragm, forming an annular reservoir or storage chamber surrounding the flow tube.

In accordance with a first embodiment, a substantially rigid annular base cap is provided at the bottom of the flow tube, with the outer perimeter of the base cap being adapted for releasably sealing circumferential engagement with the skirt, so as to close off the bottom of the storage chamber. The dispensing cap is threaded or otherwise adapted for sealing attachment to a beverage container, such that the skirt and storage chamber are disposed within the throat or neck of the container. A downward force applied to the flow tube will induce resilient downward deformation of the diaphragm, disengagement of the base cap from the skirt, and downward displacement of the base cap relative to the skirt, thus opening the lower end of the storage chamber and releasing the contents thereof into the container, whereupon the container can be agitated to mix the storage chamber contents with a liquid in the container.

The flow tube extends above the storage chamber and terminates in a flow assembly which enables consumption of the container contents without removing the dispensing cap from the container. The upper end of the flow tube is closed off, and is sealingly engageable with an opening in a cap sleeve which is slidingly mounted over a wall structure defining a flow chamber. The portion of the flow tube disposed within the flow chamber has openings to permit liquid flowing in the flow tube to pass into the flow chamber. When the cap sleeve is in its closed position with the upper end of the flow tube engaging the cap sleeve opening, liquid cannot flow out of the container through the cap sleeve opening. When the cap is slidingly moved to its open position, with the upper end of the flow tube disengaged from the cap sleeve opening, liquid can flow from the container, through the flow tube, into the flow chamber, and out the cap sleeve opening.

In accordance with a second embodiment, the bottom of the storage chamber is closed off by a substantially impermeable membrane which is sealingly attached to the periphery of the skirt. The membrane may be made from metal foil, but other materials may be used for the membrane without departing from the scope of the disclosure. In this embodiment, the open lower end of the flow tube is initially disposed slightly above the membrane, and is configured such that it can readily pierce the membrane when pushed downward against the membrane. The other elements of this embodiment of the dispensing cap, including the flow assembly, are similar to corresponding elements of the first embodiment described previously.

A downward force applied to the flow tube will induce resilient downward deformation of the diaphragm and cause the lower end of the flow tube to pierce the membrane, thus opening the lower end of the storage chamber and dispensing its contents (i.e., additive substance) into the container, whereupon the container can be agitated to mix the additive substance with a liquid in the container. The container can then be tipped back so that the mixture formed inside the container can flow through the flow tube and flow assembly and out the cap sleeve opening. In this embodiment, the portion of the flow tube below the diaphragm may optionally be provided with slots or other types of openings to enhance flow of the mixed liquid into and out of the flow tube.

BRIEF DESCRIPTION OF THE DRAWINGS

Embodiments in accordance with the present disclosure will now be described with reference to the accompanying figures, in which numerical references denote like parts, and in which.

DETAILED DESCRIPTION OF THE PREFERRED EMBODIMENT

Figure 1:
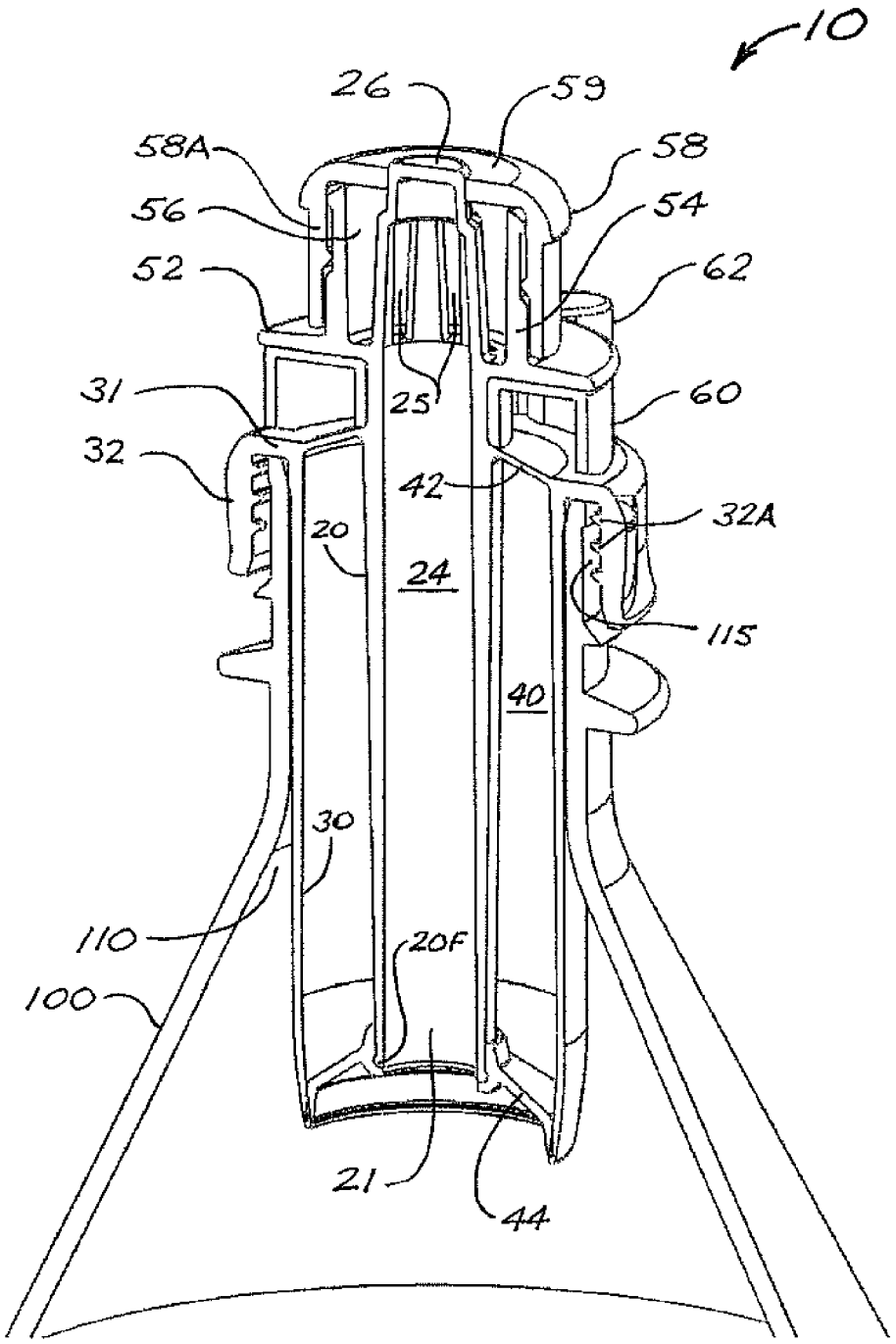
FIG. 1 is an isometric section through a first embodiment of a dispensing cap in accordance with the present disclosure, with the dispensing cap being screwed onto a beverage container and with security tab in place.

FIGS. 1-5 illustrate a first embodiment of a dispensing cap 10 in accordance with the present disclosure, shown mounted on a beverage container 100 having a throat section 110. In the illustrated embodiment, the dispensing cap 10 is adapted for mounting on a container 100 having a threaded neck, but this is not essential; dispensing cap 10 may be readily adapted for use with containers designed to receive alternative, non-threaded types of closures. All components of dispensing cap 10 are preferably made of a rigid or semi-rigid plastic material, but other materials providing suitable functional effectiveness may be used without departing from the scope of the present disclosure.

Dispensing cap 10 has a flow tube 20 having an upper end 20U and a lower end 20L. In the illustrated embodiment, flow tube 20 is of generally cylindrical configuration, and the descriptions herein will be in the context of a generally cylindrical flow tube 20. Persons of ordinary skill in the art will readily appreciate, however, that flow tube 20 could be of a different geometric configuration without departing from the scope of the present disclosure.

Having reference to FIG. 2, flow tube 20 may be considered as comprising four contiguous sections, as follows:

- lower section 22L, extending upward from lower end 20L of flow tube 20 to a first intermediate point 20-1;
- middle section 22M, extending upward from first intermediate point 20-1 to a second intermediate point 20-2 a selected distance above first intermediate point 20-1;
- a perforated section 22P, extending upward from second intermediate point 20-2 to a third intermediate point 20-3 a selected distance above second intermediate point 20-2; and
- a top section 22T, extending upward from third intermediate point 22-3 to upper end 20U of flow tube 20.

Lower end 20L of flow tube 20 has an opening 21 which leads into a flow passage 24 extending the full length of flow tube 20, from lower end 20L to upper end 20U. The cylindrical walls of flow tube 20 are solid except within perforated section 22P, which is formed with a plurality of perforations 25, for purposes to be explained herein. In the preferred and illustrated embodiment, perforations 25 are provided in the form of vertical slots, but this is not essential; perforations 25 could alternatively be provided in various other forms (e.g., round holes). In the preferred embodiment shown in the Figures, upper end 20U of flow tube 20 is closed off by a cap member 26. Top section 22T of flow tube 20 is preferably somewhat smaller in cross-sectional diameter than perforated section 22P. However, this feature is not essential, and in alternative embodiments top section 22T and perforated section 22P may be of substantially the same diameter.

Dispensing cap 10 also has a cylindrical skirt 30 which surrounds lower section 22L of flow tube 20, so as to form a generally annular storage chamber 40 between the inner surface of skirt 30 and the outer surface of lower section 22L of flow tube 20. The outer diameter of skirt 30 is smaller than the inner diameter of throat section 110 of the container 100 on which dispensing cap 10 is to be installed, such that skirt 30 may be readily disposed within throat section 110. Preferably (but not necessarily), the outer diameter of skirt 30 is only slightly smaller than the inner diameter of throat section 110, thus maximizing the volume of storage chamber 40. Skirt 30 has an upper end 30U and a lower end 30L. An annular skirt flange 31 extends radially outward from upper end 30U of skirt 30, and transitions at its outmost edge to a downwardly extending cylindrical collar 32. As may be seen in the Figures, collar 32 has internal threads 32A and is of a suitable diameter such that it can be screwed onto the top of container 100 with its internal threads 32A engaging the external threading 115 at the top of container 100.

A resiliently flexible and generally annular diaphragm 42 is circumferentially and sealingly connected to flow tube 20 at first intermediate point 20-1, and extends radially outward therefrom to circumferentially and sealingly connect to upper end 30U of skirt 30. Flow tube 20, skirt 30, and diaphragm 42 are preferably (but not necessarily) molded as an integral unit. Although this integral unit may thus be made of a rigid or semi-plastic material, the required flexibility of diaphragm 42 may be provided by making diaphragm 42 substantially thinner than the components to which it is connected (i.e., flow tube 20 and skirt 30).

A substantially rigid and generally annular base cap 44 is circumferentially and sealingly connected to flow tube 20 at lower end 20L, and extends generally radially outward therefrom for circumferentially sealing engagement with lower end 30L of skirt 30. Unlike the connection of diaphragm 42 to upper end 30U of skirt 30, the circumferential engagement of base cap 44 with lower end 30L of skirt 30 is not integral, but is adapted to permit ready disengagement and downward displacement of base cap 44 relative to skirt 30 in response to application of a sufficient downward force on flow tube 20 relative to skirt 30.

As shown in the Figures, base cap 44 preferably (but not necessarily) has a downward slope radially away from lower end 20L of flow tube 20, to promote efficient and complete dispensing of an additive substance from.

Also as shown in the Figures, base flange 44 may be provided in the form of a discrete component that snaps onto a circumferential retention flange 20F formed at lower end 20L of flow tube 20. In alternative embodiments, however, base cap 44 could also be integrally formed or molded with flow tube 20.

Figure 2:
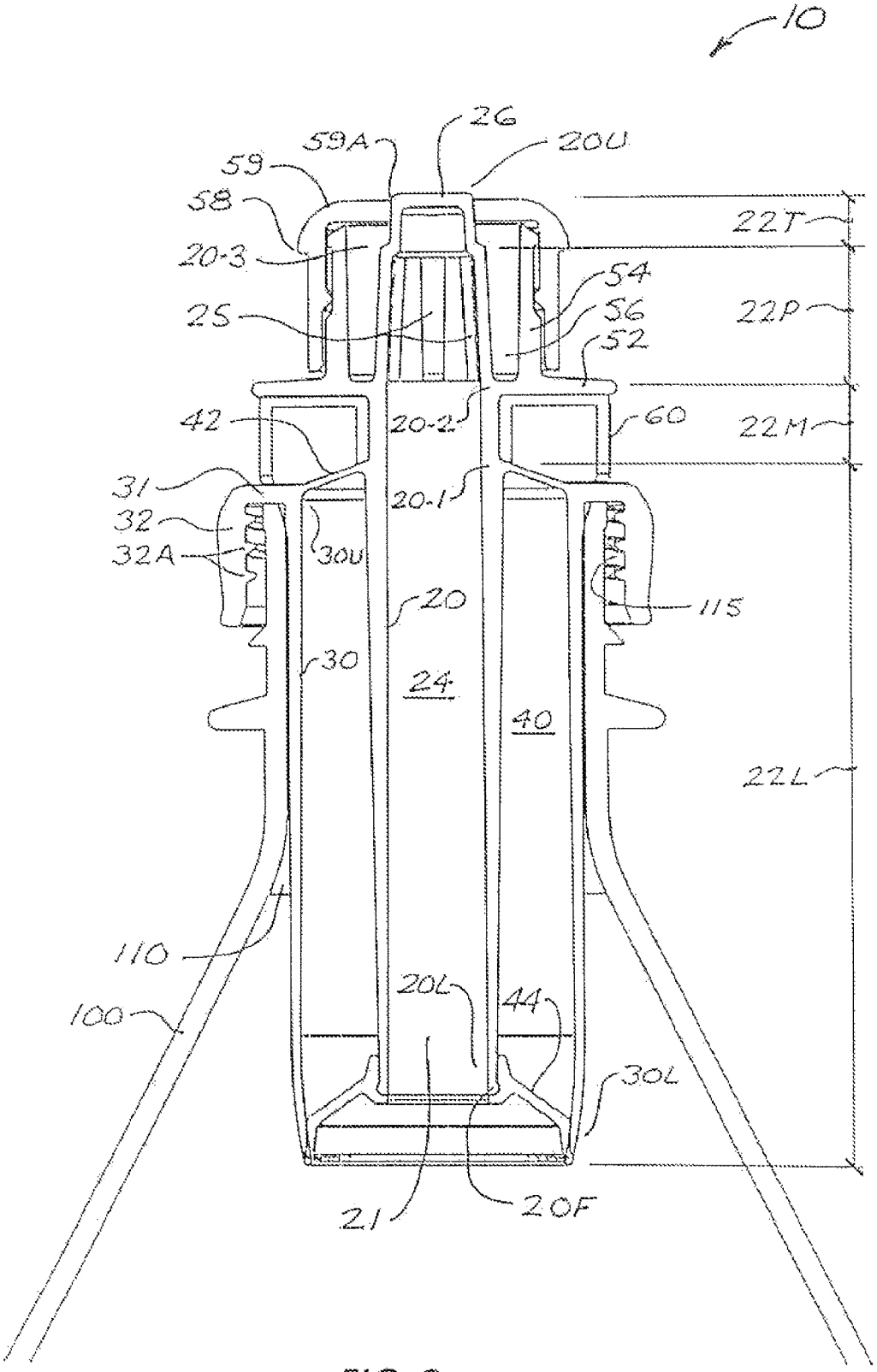
FIG. 2 is an elevational section through the dispensing cap of FIG. 1.
Figure 3:
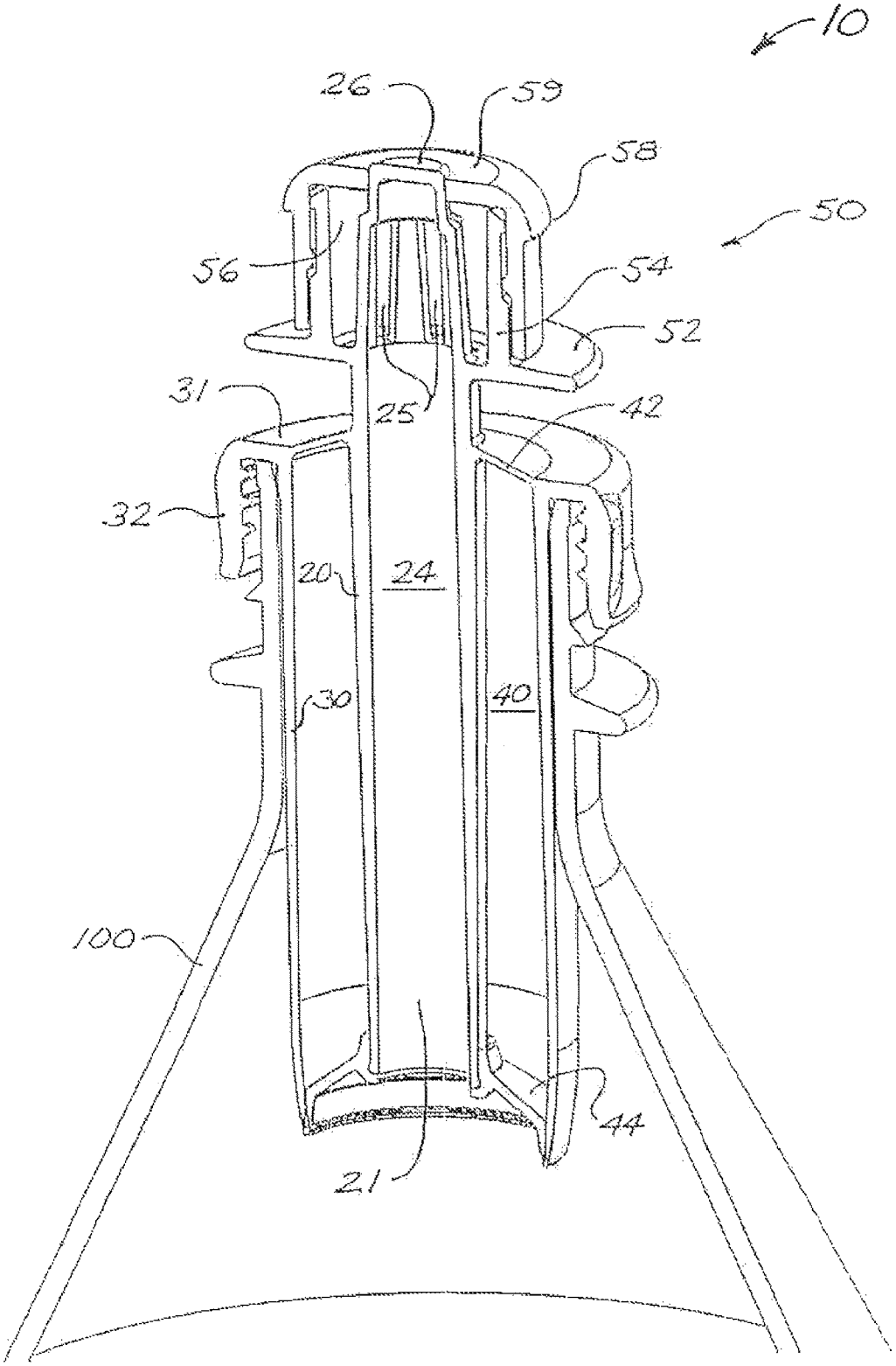
FIG. 3 is an isometric section through the dispensing cap of FIG. 1, with security tab removed in preparation for dispensing additive into the container.

Having reference to FIGS. 1, 2, and 3 and the foregoing descriptions, it will be seen that when base cap 44 is sealingly engaged with lower end 30L of skirt 30, annular storage chamber 40 becomes a sealed and preferably liquid-tight chamber. Storage chamber 40 may be filled or partially filled with a selected additive substance in liquid, powder, or other form as appropriate.

Figure 4:
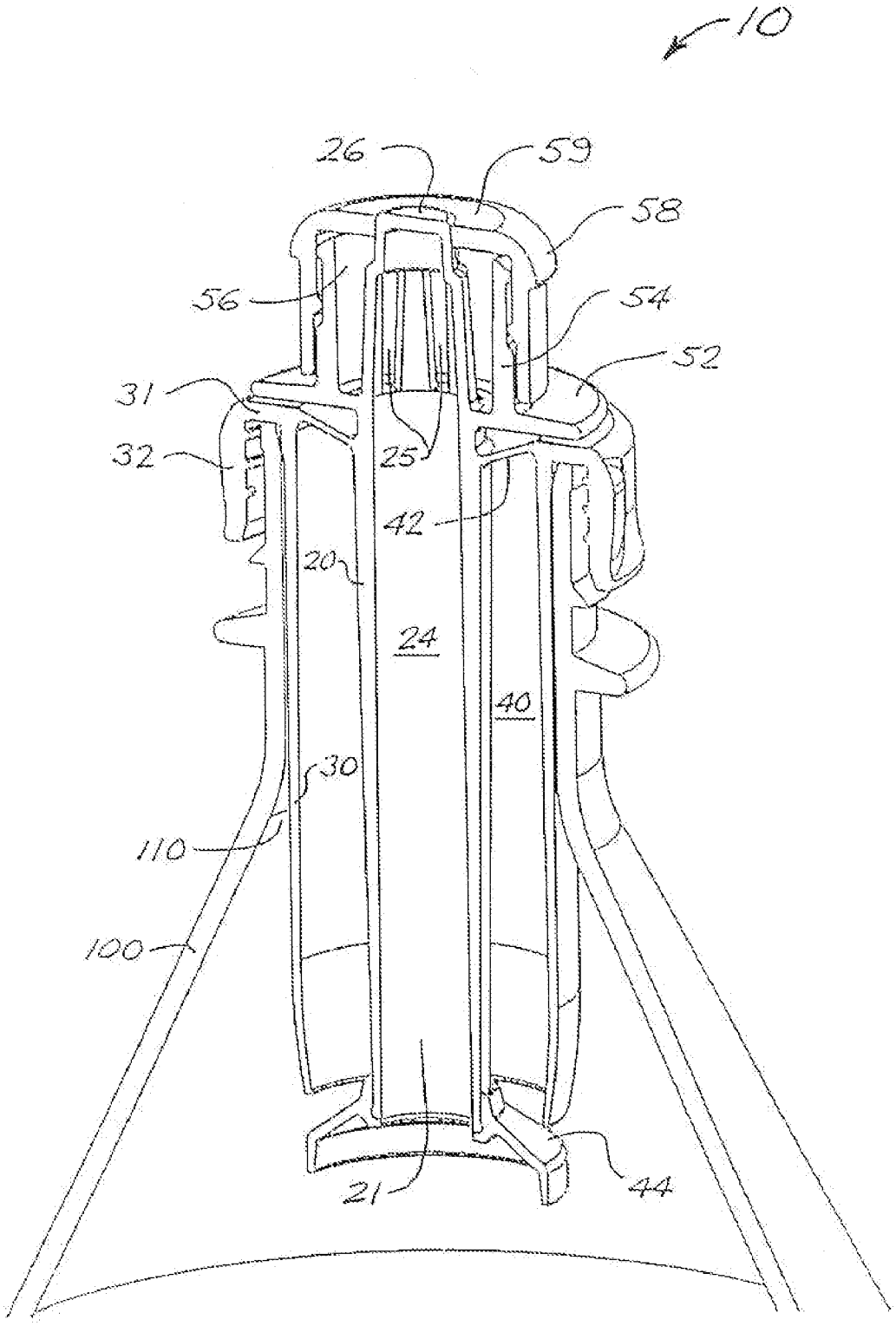
FIG. 4 is an isometric section through the dispensing cap of FIG. 1, shown after actuation to dispensing additive from the reservoir.
Figure 5:
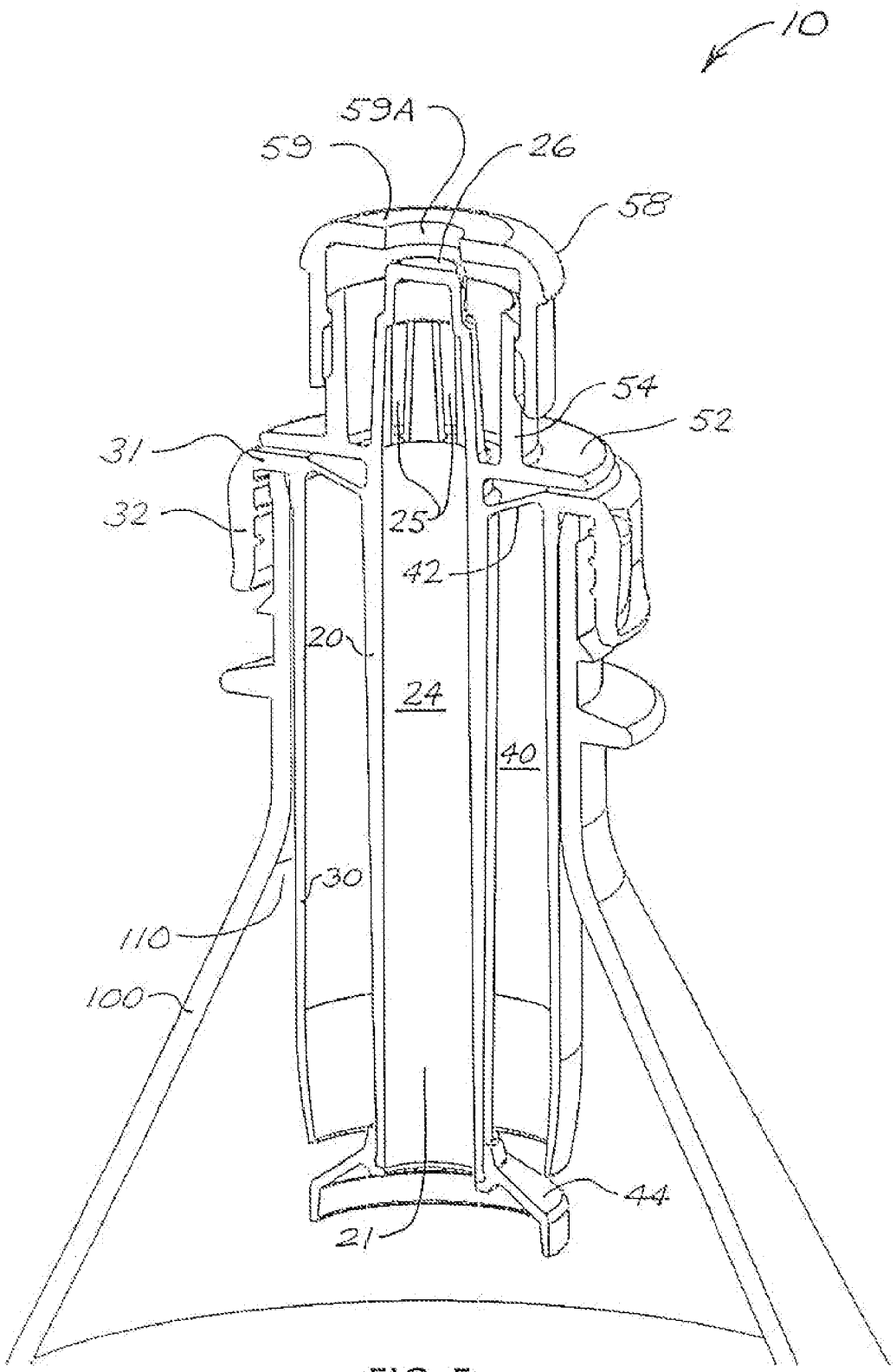
FIG. 5 is an isometric section through the dispensing cap of FIG. 1, shown after actuation to allow consumption from the container.

Dispensing cap 10 also incorporates a beverage flow assembly 50, which may be most clearly understood with reference to FIG. 3. In the illustrated embodiment, flow assembly 50 comprises a base flange 52 which extends radially outward from second intermediate point 20-2 on flow tube 20. An open-topped cylindrical flow chamber wall 54 (alternatively referred to herein as an open-topped perimeter retaining wall) extends upward from base flange 52, forming a generally annular flow chamber 56 surrounding perforated section 22P of flow tube 20. A generally dome-shaped, cylindrical cap sleeve 58 having an open-bottomed perimeter sidewall 58A and a top closure member 59, with a flow opening 59A formed in top closure 59, is disposed over and around flow chamber wall 54 such that cap sleeve 58 is slidingly movable relative to cylindrical flow chamber wall 54 between:

- a closed position (as seen in FIGS. 1 to 4) in which top section 22T of flow tube 20 sealingly engages flow opening 59A; and
- an open position (as seen in FIG. 5) in which top closure 59 is displaced to a position above top section 22T of flow tube 20 such that liquid can flow out of flow chamber 56 through flow opening 59A.

Flow chamber wall 54 and cap sleeve 58 are designed and configured such that cap sleeve 58 forms a substantially liquid-tight seal against flow chamber wall 54 as cap sleeve 58 moves between the closed and open positions. The Figures conceptually illustrate one particular design whereby this liquid-tight seal may be achieved, but the present disclosure is not limited to this or any other particular method or means of providing a sliding seal between cap sleeve 58 and flow chamber wall 54, which as persons skilled in the art will recognize can be accomplished in a variety of ways using known technology.

Although flow chamber wall 54 is described and illustrated herein as being generally cylindrical, persons skilled in the art will readily appreciate that flow chamber wall 54 and flow chamber 56 could be of different geometric configurations (with corresponding modifications to cap sleeve 58) without departing from the scope of the present disclosure.

As shown in FIGS. 1 and 2, a generally annular security tab 60, with pull tab 62, is preferably (but not necessarily) disposed provided around middle section 22M of flow tube 20, between skirt flange 31 and base flange 52. As will be explained in greater detail below, security tab 60 prevents unintentional release of the additive substance from storage chamber 40, as could result from inadvertent downward displacement of flow tube 20 relative to skirt 30. Accordingly, security tab 60 will typically be left in place until it is desired to release the additive substance into container 100.

The particular security tab configuration shown in the Figures is exemplary only. Embodiments incorporating a security tab are not limited or restricted to the use of a security device as specifically illustrated herein or in accordance with any other particular design or style.

The operation of dispensing cap 10 may be readily understood with reference to the Figures and the foregoing descriptions. FIGS. 1 and 2 illustrate dispensing cap 10 threadingly mounted over the threaded neck of a beverage container 100, with skirt 30 (and lower section 22L of flow tube 20) disposed within throat 110 of container 100. Security tab 60 is in place, storage chamber 40 has been filled with a selected additive substance (not shown), and cap sleeve 58 is in the closed position.

FIG. 3 illustrates dispensing cap 10 essentially as in FIGS. 1 and 2 but with security tab 60 removed.

FIG. 4 illustrates dispensing cap 10 in the "dispense" position, which is achieved by applying a downward force on top closure 59 (and flow assembly 50 as a whole), such that flow tube 20 moves downward within skirt 30 (with corresponding deformation and downward deflection of diaphragm 42), causing base cap 44 to become disengaged from and displaced below lower end 30L of skirt 30, such that the additive substance will readily flow out of storage chamber 40 and into container 100, whereupon the additive substance will become mixed with the liquid (e.g., water; sport beverage) in container 100.

FIG. 5 illustrates dispensing cap 10 in the open or "consume" position, which is achieved subsequent to the release of the additive substance from storage chamber 40, by simply sliding cap sleeve 58 into the "consume" position as previously described. With dispensing cap 10 in the "consume" position, container 100 may be tilted or inverted to allow the mixed beverage to flow through opening 21 of flow tube 20 into flow passage 24 within flow tube 20, and thence through perforations 25 in perforated section 22P of flow tube 20 into flow chamber 56, and out through flow opening 59A in top closure 59.

A particular advantage of this first embodiment of the dispensing cap is that it provides the beverage consumer with the option of drinking the base liquid from container 100 without releasing the additive substance from storage chamber 40 into container 100. This may be done by simply by sliding cap sleeve 58 into the "open" position without displacing flow tube 20; this can be done with security tab 60 either removed or in place.

Another advantage of this first embodiment is that it gives the beverage consumer the option of releasing only a portion of the additive substance into container 100. This can be done by, for example, displacing flow tube 20 only partially downward and then retracting flow tube 20 (by pulling upward on base flange 52) so as to sealingly re-engage base cap 44 with lower end 30L of skirt 30, thus retaining the remaining amount of additive substance within storage chamber 40 until the consumer is ready to dispense it into container 100 at a later time.

Figure 6:
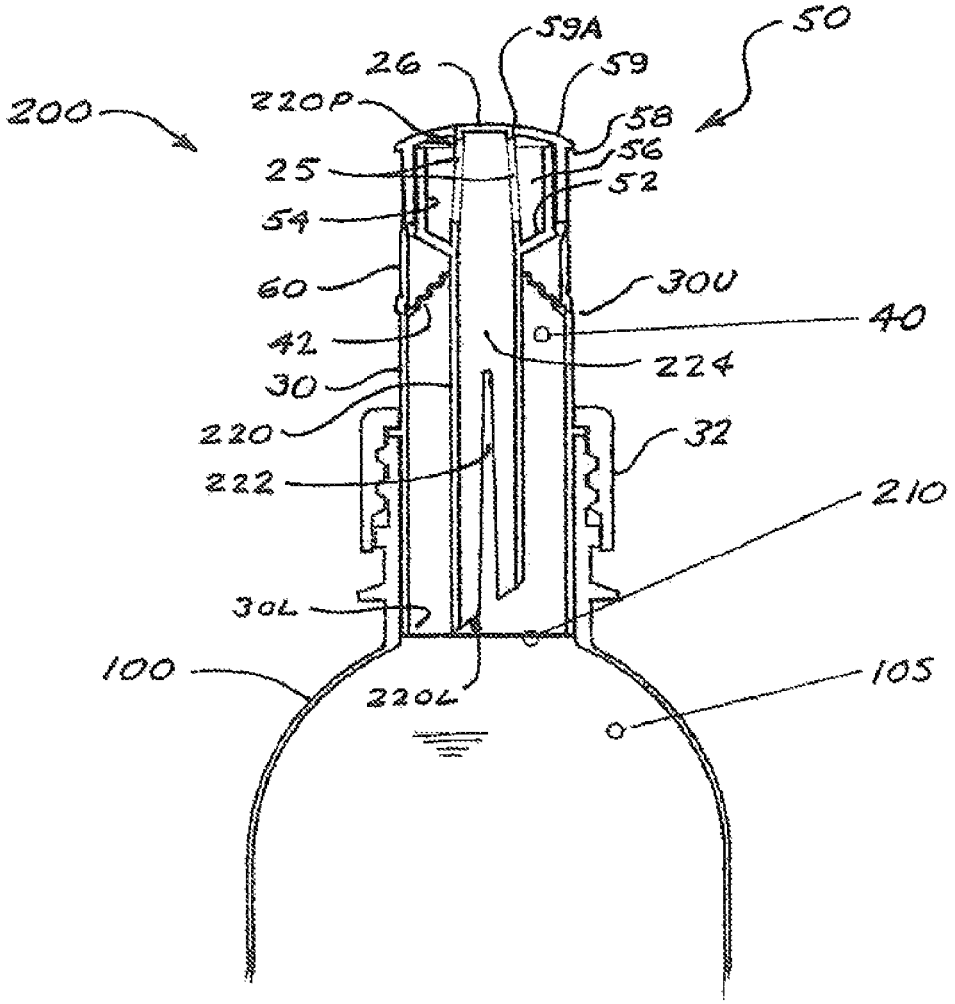
FIG. 6 is a vertical section through second embodiment of a dispensing cap in accordance with the present disclosure, shown with an additive substance stored in the storage chamber and with the security tab being removed in preparation of dispensing the additive substance.
Figure 7:
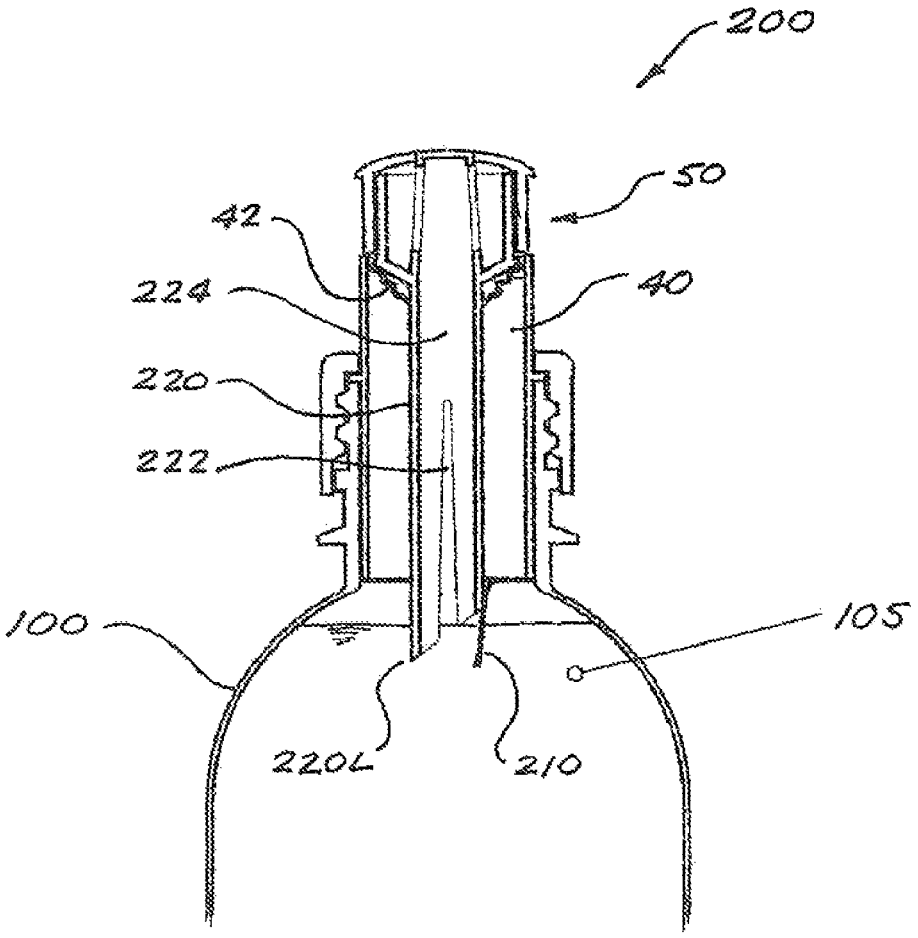
FIG. 7 is a section through the dispensing cap of FIG. 6, showing the lower end of the flow tube having pierced the membrane to dispense the additive substance from the storage chamber into the container.
Figure 8:
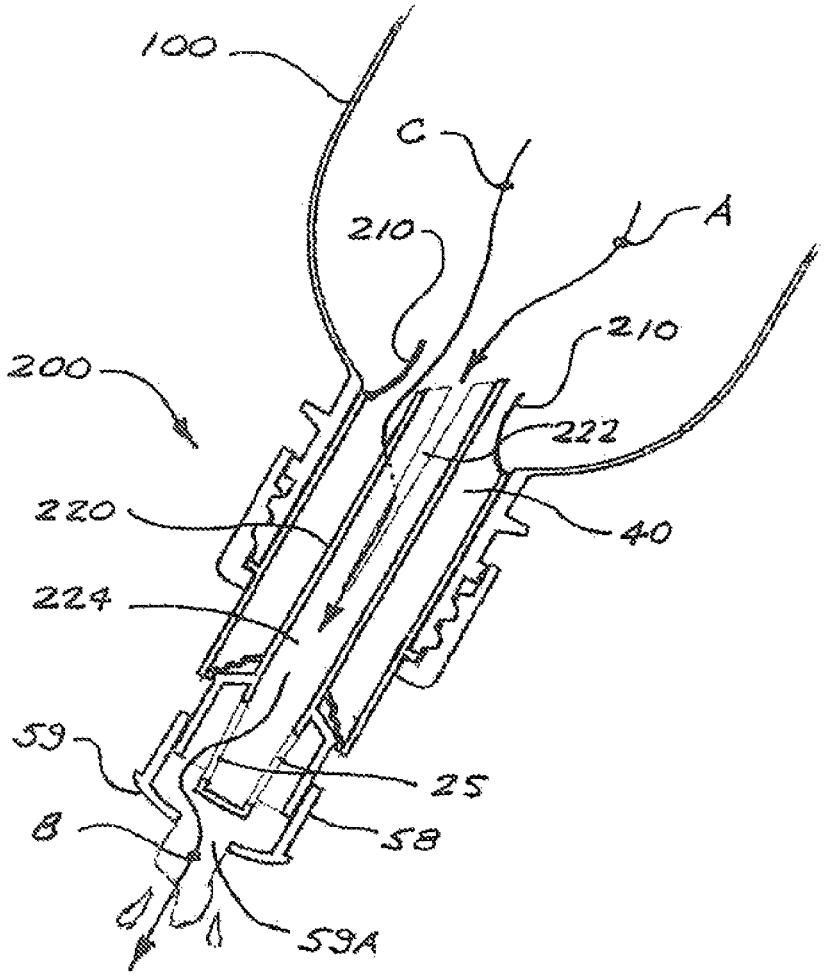
FIG. 8 is a section through the dispensing cap of FIG. 6, illustrating the flow path from the container through the dispensing cap and out the cap sleeve opening.

FIGS. 6-8 illustrate a dispensing cap 200 in accordance with a second embodiment. In FIGS. 6-8, elements similar or identical to corresponding components of the first embodiment illustrated in FIGS. 1-5 are denoted by the same reference numbers.

FIG. 6 shows dispensing cap 200 mounted to a beverage container 100 containing a liquid 105. Dispensing cap 200 comprises a flow tube 220 having an open-ended lower end 200L and defining a flow passage 224. The uppermost region of flow tube 200 defines a perforated section 220P having one or more perforations 25, for purposes as previously described with reference to the embodiment in FIGS. 1-5. The uppermost end of perforated section 220P is closed off by a cap member 26.

A cylindrical skirt 30 surrounds a lower portion of flow tube 220 so as to form a generally annular storage chamber 40. A resiliently flexible and generally annular diaphragm 42 is circumferentially and sealingly connected to flow tube 200 at a point below perforations 25, and extends radially outward therefrom to circumferentially and sealingly connect to the upper end 30U of skirt 30, thereby closing off the top of storage chamber 40. As illustrated in FIG. 6, diaphragm 42 in its initial, pre-use configuration has a generally conical form, with its connection to flow tube 220 being at a level higher than its connection to skirt 30. A substantially impermeable membrane 210 is sealingly attached to the periphery of skirt 30 at its lower end 30L, thereby closing off the bottom of storage chamber 40. Membrane 210 may be made from metal foil, but other materials may be used for the membrane without departing from the scope of the disclosure.

Dispensing cap 200 also incorporates a beverage flow assembly 50 generally as previously described with reference to FIG. 3, and comprising a base flange 52 and an open-topped cylindrical flow chamber wall 54 which extends upward from base flange 52 to form a generally annular flow chamber 56 surrounding perforated upper section 220P of flow tube 220. A generally dome-shaped, cylindrical cap sleeve 58 having a top closure member 59, with a flow opening 59A formed in top closure 59, is disposed over and around flow chamber wall 54 such that cap sleeve 58 is slidingly movable relative to cylindrical wall 54 between closed and open positions as previously described.

As illustrated in FIGS. 6-8, base flange 52 may be of a downwardly-oriented, generally conical configuration. However, this configuration is not essential, and in variant embodiments base flange 52 could be of a different configuration (generally flat or planar, for example, as in the embodiment of FIGS. 1-5).

Dispensing cap 200 optionally may be provided with a generally annular security tab 60 disposed between diaphragm 42 and base flange 52, such that dispensing cap 200 cannot be actuated to dispense the contents of storage chamber 40 into container 100 until security tab 60 has been removed.

As seen in FIG. 6, when dispensing cap 200 is in its pre-use configuration, with a desired amount of additive substance having been placed in storage chamber 40, lower end 200L of flow tube 200 will be disposed above and fairly close to membrane 210. Lower end 200L of flow tube 200 is designed and configured such that it will readily pierce or puncture membrane 210 when pressed downward against membrane 210. In FIGS. 6-8, lower end 200L of flow tube 200 is shown as having a chisel point (similar to the point of a hypodermic needle). However, this is only one example of how lower end 200L of flow tube 220 could be configured to facilitate piercing of membrane 210, and the present disclosure is not limited to this or any other particular means or method for providing this functionality.

The operation and use of dispensing cap 200 may be readily understood with reference to FIGS. 7 and 8. In FIG. 7, a downward force has been applied to flow tube 220, thereby resiliently deforming diaphragm 42 to a downwardly-deflected position as shown, and causing lower end 200L of flow tube 220 to pierce membrane 210, thus allowing the additive substance to flow out of storage chamber 40 into container 100. To facilitate the flow of the additive substance out of storage chamber 40 into container 100, the side wall of flow tube 220 may be provided with one or more slots 222 (or openings of a different configuration) such that the additive substance can flow from storage chamber 40 through slots 222 and then downward through flow passage 224 of flow tube 220 and exit lower end 200L of flow tube 220 into container 100. In preferred embodiments, however, lower end 200L of flow tube 220 will be configured to pierce membrane 210 in such as manner as to create a large enough opening in membrane 210 to allow the additive substance to flow directly out of storage chamber 40 into container 100 without having to flow through slots 222 and flow passage 224 (or to flow partially via flow passage 224 and partly directly out of storage chamber 40 into container 100).

FIG. 8 illustrates how liquid 105, after being mixed with the additive substance dispensed from storage chamber 40, can flow through dispensing cap 200 for consumption. When container 100 is tipped back or inverted by a consumer as shown, the liquid mixture can flow into directly into flow chamber 224 of flow tube 220 via the open lower end 220L of flow tube 200 (as indicated by flow path arrows A in FIG. 8), and thence through openings 25 in perforated section 220P of flow tube 200 and out through flow opening 59A in top closure 59 (as indicated by flow path arrows B). Alternatively or in addition, the liquid mixture can flow through the opening in membrane 210 external to flow tube 200 and then through slots 222 in the side wall of flow tube 200 into flow chamber 224 (as indicated by flow path arrows C), and thence via flow path B to exit through flow opening 59A in top closure 59. In unillustrated alternative embodiments, lower end 220L could be closed (but still adapted to pierce membrane 210), such that all flow of the additive substance from storage chamber 40 into container 100 is directly through the opening in pierced membrane 210, and such that all flow of the liquid mixture from container 100 and out through flow opening 59A is via flow paths C and B in sequence.

It will be readily appreciated by those skilled in the art that various modifications of the disclosed dispensing cap may be devised without departing from the scope of the disclosure, and all such modifications are intended to come within the scope of the disclosure and the claims appended hereto. It is to be especially understood that dispensing caps in accordance with the present disclosure not intended to be limited to illustrated embodiments, and that the substitution of a variant of a claimed element or feature, without any substantial resultant change in functionality, will not constitute a departure from the scope of the disclosure.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element. The word "sealing" and derivative forms thereof, as used herein, are to be understood as connoting the provision of a substantially liquid-tight seal. As used in this patent document, the words "cylindrical", "annular", or other words relating to shape, form, or properties are not intended to denote or require geometrical or technical precision, and are accordingly to be understood as denoting general or substantial conformity (e.g., "cylindrical" would be understood as "at least substantially cylindrical") unless the context clearly requires otherwise.

What is claimed is:

1. A dispensing cap sealingly mountable to a beverage container having a throat section, said dispensing cap comprising:

(a) an open-bottomed flow tube having an upper end, a lower end, and a sidewall, said sidewall having an outer perimeter;

(b) a skirt surrounding a lower region of the flow tube so as to form a reservoir between the flow tube and the skirt, with said reservoir having an upper end and a lower end, and with said skirt being adapted for disposition within the throat section of the beverage container;

(c) a resilient diaphragm, wherein said resilient diaphragm is a single piece with the flow tube sidewall and the skirt, and is sealingly connected to an upper perimeter region of the skirt and to an intermediate perimeter region of the flow tube; and (d) a membrane sealingly attached to the periphery of the skirt at a lower end thereof;

wherein:

(e) the diaphragm sealingly closes off the upper end of the reservoir, and the membrane sealing closes off the lower end of the reservoir;

(f) the flow tube extends into the reservoir, with the lower end of the flow tube being disposed above the membrane; and (g) the lower end of the flow tube is adapted to pierce the membrane upon being pressed against the membrane;

such that when the dispensing cap is mounted to the beverage container with the skirt disposed within the throat thereof and with the reservoir containing an additive substance, a downward force applied to the flow tube will resiliently deform the diaphragm, such that the lower end of the flow tube will move downward and pierce the membrane, thus allowing the contents of the reservoir to flow into the container.

2. A dispensing cap as in claim 1, further comprising a flow assembly having a cap sleeve, said cap sleeve comprising a top closure having a flow opening, and said cap sleeve being operable between:

(a) an open position allowing flow through the flow opening; and (b) a closed position preventing flow through the flow opening.

3. A dispensing cap as in claim 1 wherein the upper end of the flow tube is closed, wherein an upper region of the wall of the flow tube has one or more perforations, and wherein the dispensing cap further comprises a flow assembly, said flow assembly comprising:

(a) a base flange sealingly and integrally connected, along its inner perimeter, to the outer perimeter of the flow tube at a point below said perforations;

(b) an open-topped perimeter retaining wall having a lower end sealingly connected to the base flange so as define a chamber between the perimeter wall and the flow tube; and (c) a cap sleeve comprising a top closure and an open-bottomed perimeter sidewall extending downward from the top closure, wherein:

c.1 the top closure has a flow opening adapted for releasably sealing engagement with the upper end of the flow tube; and c.2 the perimeter sidewall is sealingly slidable over said perimeter retaining wall, between a closed position in which the upper end of the flow tube is sealingly engaged within said flow opening in the top closure, and an open position in which liquid can flow through the flow opening.

4. A dispensing cap as in claim 1, further comprising a security tab disposable around the flow tube in a region between the base flange and the diaphragm.

5. A dispensing cap for a beverage container having a throat section, said dispensing cap comprising:

(a) a flow tube having a sidewall with an outer perimeter, an upper end closed off by an integral closure member, and an open lower end, with an upper region of said sidewall having one or more perforations;

(b) an annular base flange sealingly and integrally connected, along its inner circumference, to the outer perimeter of the flow tube at a point below said perforations;

(c) an open-topped perimeter retaining wall having a lower end sealingly connected to the base flange so as to define an annular flow chamber between the perimeter retaining wall and the flow tube;

(d) a cap member having a top closure and an open-bottomed perimeter sidewall extending downward from the top closure, wherein:

d.1 the top closure has a flow opening adapted for releasably sealing engagement with the upper end of the flow tube; and d.2 the perimeter sidewall is sealingly slidable over said perimeter retaining wall, between a closed position in which the upper end of the flow tube is sealingly engaged within said flow opening in the top closure, and an open position in which liquid can flow through the flow opening;

(e) a cylindrical skirt surrounding a lower region of the flow tube and defining an annular reservoir therebetween, said skirt having an upper end and a lower end;

(f) a membrane sealing attached to the periphery of the skirt at a lower end thereof;

(g) an annular diaphragm, said diaphragm being a single piece with the flow tube sidewall and the skirt, and being sealingly connected:

g.1 along its inner circumference, to the outer perimeter of the flow tube sidewall at a point below the base flange; and g.2 along its outer circumference, to the upper end of said skirt; and (h) an annular collar extending outward from the upper end of the skirt, and adapted for sealing connection to a beverage container when the skirt is disposed within the throat section of the container;

wherein:

(i) the diaphragm sealingly closes off the upper end of the reservoir, and the membrane sealing closes off the lower end of the reservoir;

(j) the flow tube extends into the reservoir, with the lower end of the flow tube being disposed above the membrane; and (k) the lower end of the flow tube is adapted to pierce the membrane upon being pressed against the membrane;

such that when the dispensing cap is mounted to the beverage container with the skirt disposed within the throat thereof and with the reservoir containing an additive substance, a downward force applied to the flow tube will resiliently deform the diaphragm, such that the lower end of the flow tube will move downward and pierce the membrane, thus allowing the contents of the reservoir to flow into the container.

6. A dispensing cap as in claim 5, further comprising a security tab disposable around the flow tube in a region between the base flange and the diaphragm.

* * * * *